US010421000B1

(12) United States Patent
Marin et al.

(10) Patent No.: US 10,421,000 B1
(45) Date of Patent: Sep. 24, 2019

(54) GOLFER FOOT STABILIZING DEVICE

(71) Applicants: Erma Marin, Clements, CA (US); Frank Marin, Clements, CA (US)

(72) Inventors: Erma Marin, Clements, CA (US); Frank Marin, Clements, CA (US)

( * ) Notice: Subject to any disclaimer, the term of this patent is extended or adjusted under 35 U.S.C. 154(b) by 0 days.

(21) Appl. No.: 16/038,413

(22) Filed: Jul. 18, 2018

(51) Int. Cl.
*A63B 69/36* (2006.01)
*A63B 102/32* (2015.01)

(52) U.S. Cl.
CPC ..... *A63B 69/3667* (2013.01); *A63B 2102/32* (2015.10); *A63B 2210/50* (2013.01)

(58) Field of Classification Search
CPC ..... A63B 69/3667; A63B 2102/32; A63B 2210/50; A63B 69/3641; A63B 69/3673; A63B 69/3608
USPC ..... 473/270, 271, 217, 409, 218
See application file for complete search history.

(56) References Cited

U.S. PATENT DOCUMENTS 3,951,407 A * 4/1976 Calacurcio ..... A43B 5/001 473/217
5,062,643 A * 11/1991 Bibbey ..... A63B 69/3608 473/217
5,544,919 A * 8/1996 Tinkler ..... A63C 17/0006 280/809
6,638,176 B1 * 10/2003 Hayes ..... A63B 69/0002 473/217
8,029,381 B2 10/2011 Papa, Jr.
9,067,117 B1 6/2015 Chacon
2006/0122003 A1 * 6/2006 Kim ..... A63B 69/0057 473/271
2012/0172141 A1 * 7/2012 Vaughan ..... A63B 69/0057 473/266

* cited by examiner

*Primary Examiner* — Michael D Dennis
(74) *Attorney, Agent, or Firm* — Sanchelima & Associates, P.A.; Christian Sanchelima; Jesus Sanchelima

(57) ABSTRACT

The present invention is a golfer's foot stabilizing device that stabilizes golfer's front foot by arresting foot movement for achieving desired angular position of golfer's body during golf swing and is easily portable. Golfer's foot stabilizing device includes arresting member and securing element. Arresting member includes base member having openings, foot arrestor member and hinge connection that pivotally connects base member and foot arrestor member such that base member is selectively folded and un-folded with respect to foot arrestor member. Securing element includes support element and projections. Projections are introduced in the ground after passing through openings such that support element arrests movement of base member on the ground. Front foot of user is positioned on base member and during swing movement of user front foot is arrested by foot arrestor member thereby achieving desired angular position. Arresting member is provided with handle that facilitates easy lifting and carrying.

4 Claims, 5 Drawing Sheets

GOLFER FOOT STABILIZING DEVICE

BACKGROUND OF THE INVENTION

1. Field of the Invention

The present disclosure relates to a device that stabilizes a golfer's foot. More particularly, the present disclosure relates to a portable golfer's foot stabilizer device that stabilizes movement of a front foot during a golf swing.

2. Description of the Related Art

During golf swing, it is desired that golfer's front foot remains stable/steady during swing for achieving desired angular position. Hence, there is a need for a device that stabilizes movement of golfer's foot to achieve desired angular position.

Several designs for golfer's training aid have been designed in the past. None of them, however, include a device that during golf swing stabilizes movement of golfer's foot and thereby assist in achieving desired angular position/shot.

Applicant believes that a related reference corresponds to U.S. Pat. No. 9,067,117 filed by Raul Chacon for a golf swing improvement device. The Raul reference discloses a device that improves a golf player's game and includes a first and second member connected with each other by way of a hinge portion. However, during operation, the device disclosed by Raul can be displaced from its original position and hence may not provide desired stability.

Another related application is U.S. Pat. No. 8,029,381 filed by Carl Papa for a device for improving a golf swing. The Carl reference discloses a portable device for improving a golf swing. However, the Carl reference does not explicitly mention about arresting foot movement to achieve desired angular position.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention is to provide a golfer's foot stabilizing device that stabilizes golfer's front foot by arresting foot movement for achieving desired angular position of golfer's body during golf swing.

It is yet another object of the present invention is to provide a golfer's foot stabilizing device that is easy to secure and remove from one position to another position on a ground.

It is still another object of the present invention is to provide a golfer's foot stabilizing device having a securing element with projections that allows easy securing and removal of the device from the ground having even surface or uneven surface or various types ground conditions having different moisture content.

It is another object of the present invention is to provide a golfer's foot stabilizing device having a foot movement arrestor that prevents movement of golfer's front foot during swing for achieving desired angular positioning of golfer's body.

It is still another object of the present invention is to provide a golfer's foot stabilizing device having a handle that facilitates easy lifting of the device in operating un-folded configuration from one place to another after completion of a one golf swing shot.

It is another object of the present invention is to provide a golfer's foot stabilizing device that is foldable and hence easy to carry from one place to another.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
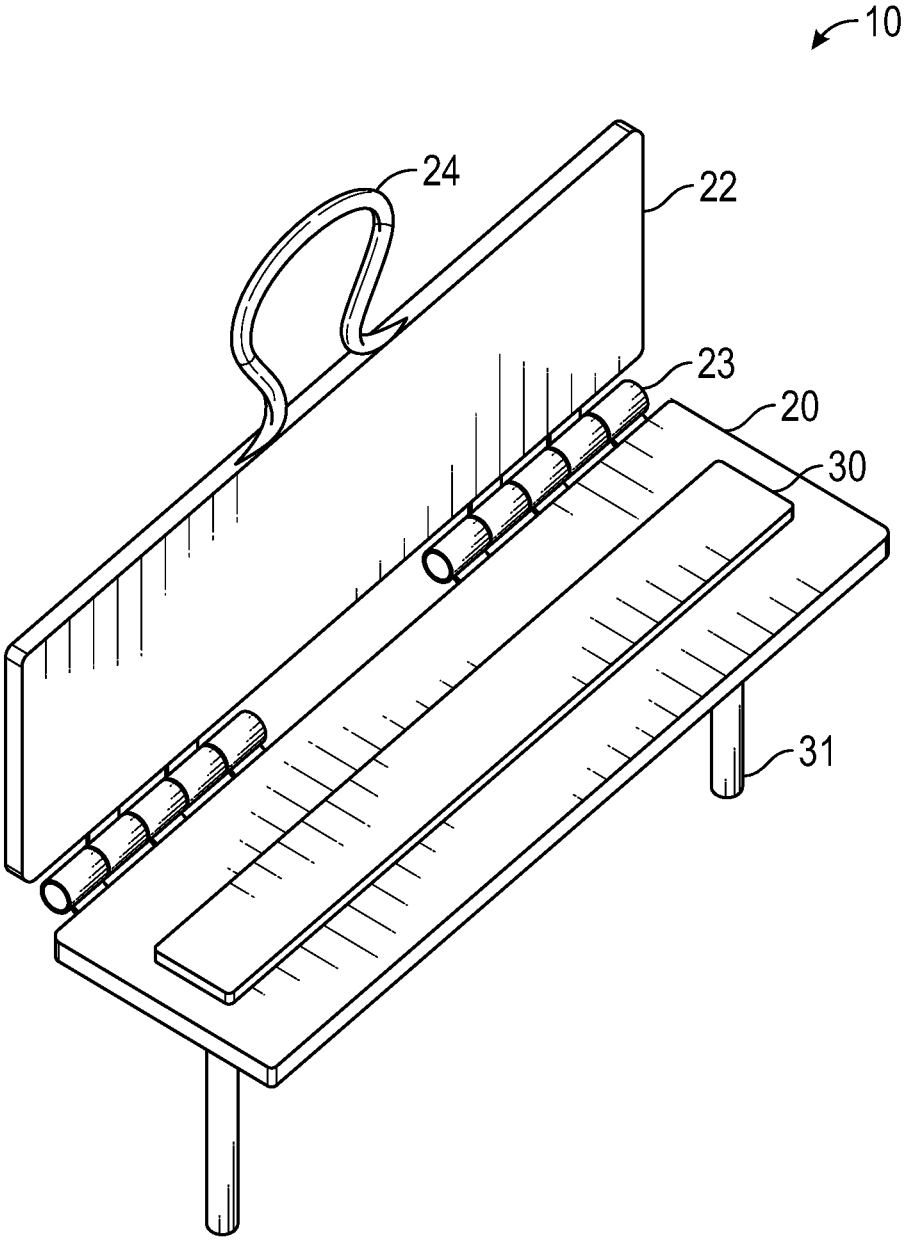
FIG. 1 represents an isometric view of the present invention showing the golfer's foot stabilizing device with a securing element attached to an arresting member that is in an operating un-folded configuration and having a handle 24.

Referring now to the drawings, FIGS. 1-6, where the present invention is generally referred to with numeral 10, it can be observed that a golfer's foot stabilizing device, in accordance with one embodiment, is provided that includes an arresting member and a securing element.

Arresting member is formed of a base member 20, a foot arrestor member 22 and a hinge connection 23 that connects base member 20 and foot arrestor member 22. Base member 20 is configured with openings 21.

Figure 4:
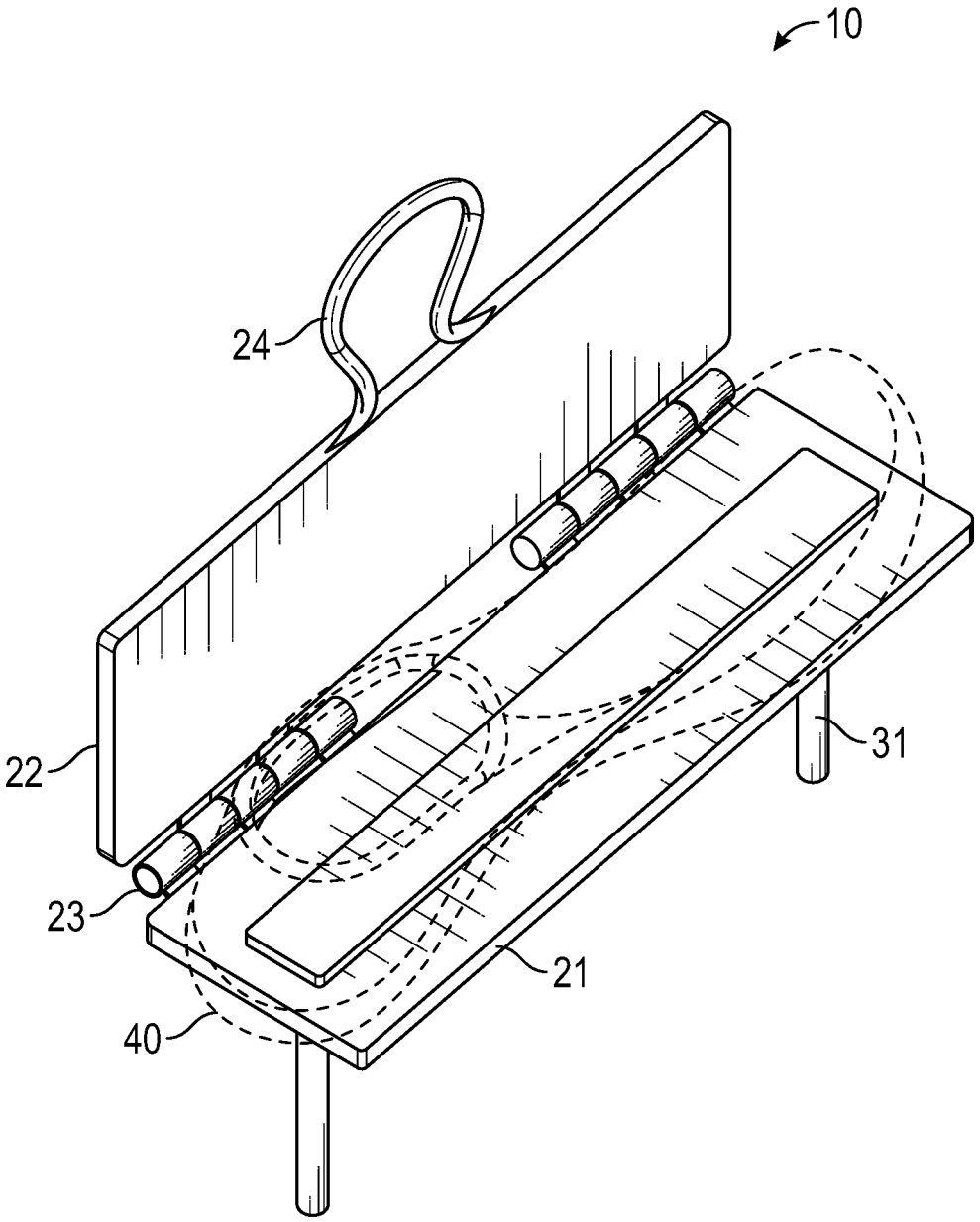
FIG. 4 is demonstrates a position of user's shoe 40 on the golfer's foot stabilizing device.
Figure 5:
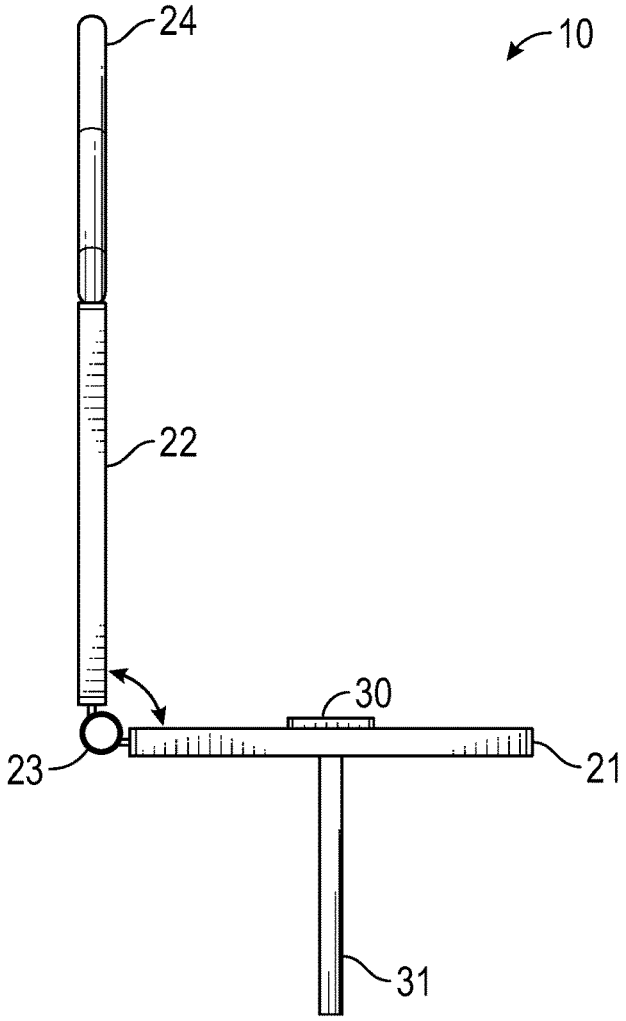
FIG. 5 demonstrates a side view of the device of the present invention.
Figure 6:
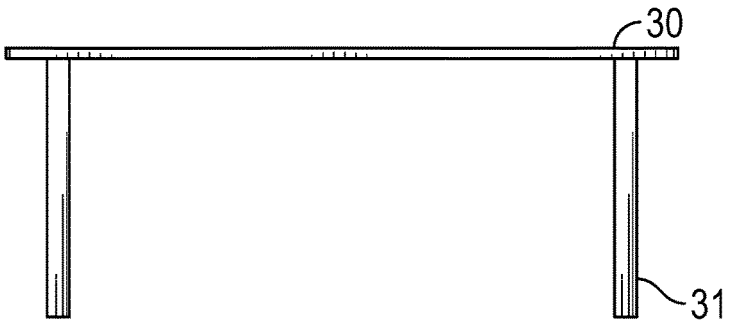
FIG. 6 demonstrates a front view of the securing element having two projections 31.

Foot arrestor member 22 is provided with a handle 24 by which golfer's foot stabilizing device 10 is lifted and moved to places. As base member 20 and foot arrestor member 22 are connected with hinge connection 23, base member 20 and foot arrestor member 22 can be folded and un-folded with respect to each other. When base member 20 and foot arrestor member 22 are folded, the device 10 is easily portable for one place to another and when base member 20 and foot arrestor member 22 are un-folded, the device 10 is used to arrest movements of the front foot of a user. As shown in FIG. 4, shoe 40 of user's front foot is positioned on base member 20 and foot arrestor member 22 arrests movement of user's front foot.

Securing element is formed of a support element 30 and projections 31. When base member 20 and foot arrestor member 22 are un-folded and a desired angle is achieved there-between, projections 31 are inserted in openings 21 of the base member 20 and the protrusions 31 are inserted in the ground such that support element 30 rests on base member 20 and base member 20 gets fixed with the ground thereby preventing movement of base member 20 on the ground. Though, the securing element of the present disclosure is described with the support element 30 and projections 31, however, the securing element can be any other type that can easily secure base member 20 with the ground and remove base member 20 from the ground.

Figure 2:
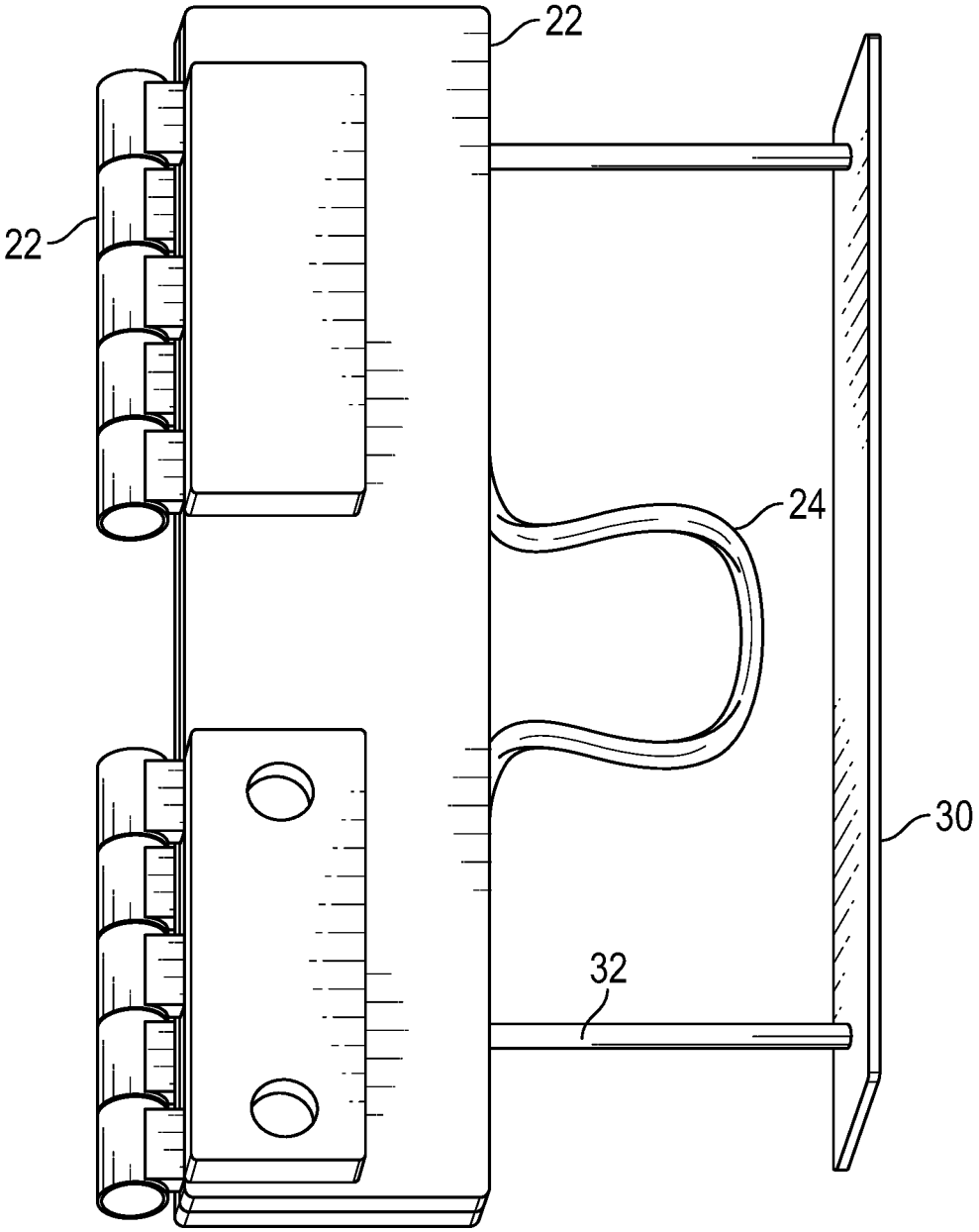
FIG. 2 demonstrates an isometric view of the present invention showing the golfer's foot stabilizing device showing the arresting member which is in a folded configuration.
Figure 3:
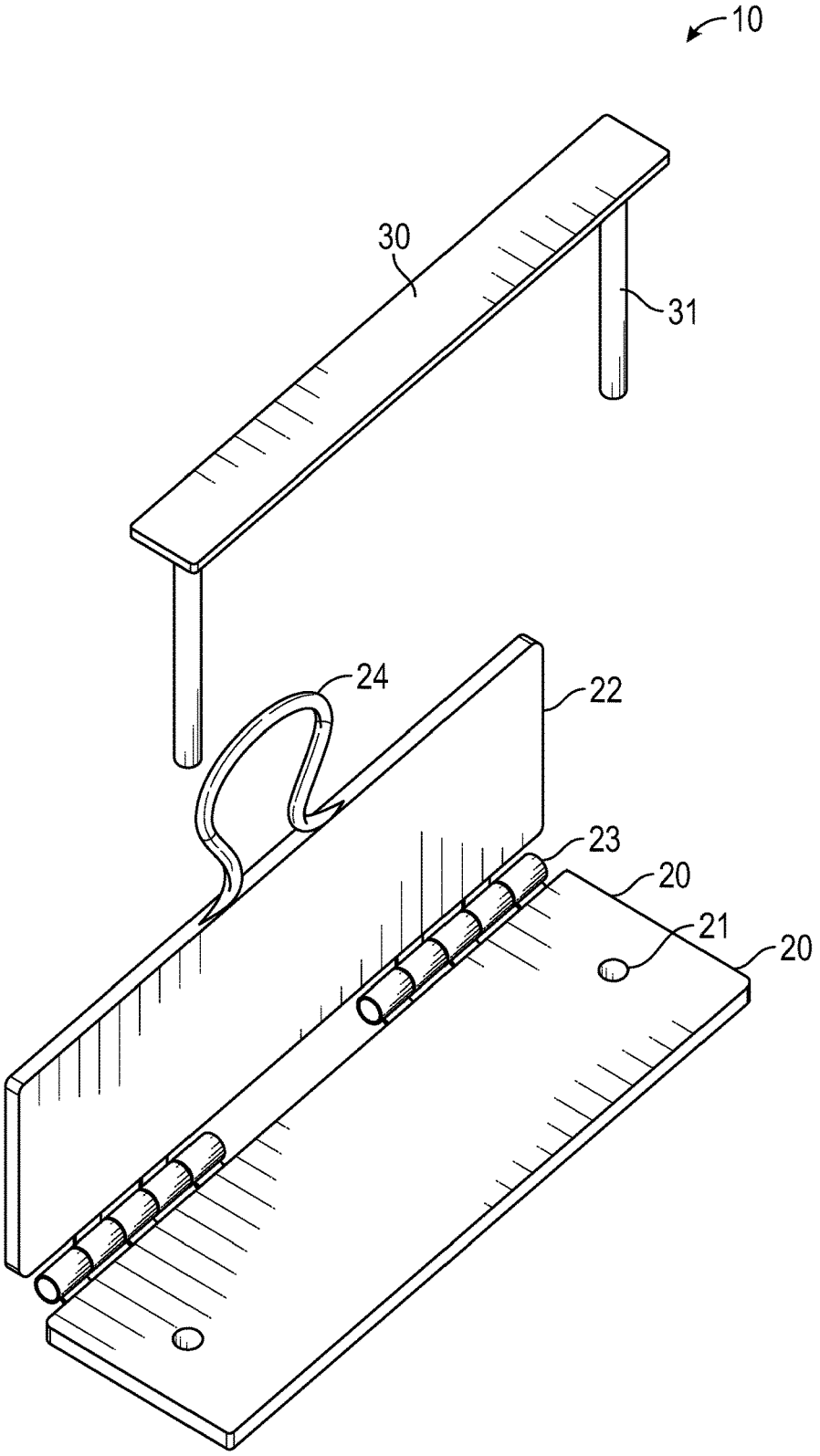
FIG. 3 shows an exploded view of the golfer's foot stabilizing device.

In operation, initially considering that golfer's foot stabilizing device 10 is in a folded configuration as shown in FIG. 2 and is carried to location where golfer will be playing. Once reached to desired location, foot arrestor member 22 is lifted to be un-folded from base member 20, by pivoting around hinge connection 23. Projections 31 of securing element are inserted into openings 21 of base member 20 and then introduced in the ground so that support element 30 arrest base member 20 on the ground and restricts movement of base member 20 on the ground. User can then position shoe 40 of front foot on base member 20 as shown in FIG. 4 so that during golf swing user's shoe 40 is prevented from angular movement because of foot arrestor member 22 and thereby stabilizes front foot. After swing shots, golfer's foot stabilizing device 10 can be lifted by handle 24 such that projections 31 is removed from the ground and easy to be carried to another position. Thus, golfer's foot stabilizing device 10 stabilizes golfer's front foot by arresting foot movement for achieving desired angular position of golfer's body during golf swing and is easily portable.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A golfer's foot stabilizing device, comprising:

a. a base member positioned parallel to a ground surface, said base member includes a top side, said base member having two spaced apart throughholes each configured to receive and allow to pass through a securing element, a support element having a rectangular configuration is rigidly mounted to said securing elements in a perpendicular relationship, said securing elements pass through said throughholes, respectively, until they are limited from extending below said base member and into said ground surface any further by said support member coming into abutting and flush engagement with said top side of said base member, said support element extends longitudinally substantially along the entire length of said top side;

b. an arresting member mounted to said base member using two spaced apart hinges, said arresting member having an open position and a closed position with respect to said base member, said open position defined by said arresting member being perpendicular to said base member, said closed position defined by said arresting member being parallel to and flat against said base member, said arresting member and said base member having equal dimensions, said arresting member and said base member made of a rigid material and each having a rectangular configuration; and c. said arresting member includes a first lateral perimeter edge and a second lateral perimeter edge, said first lateral perimeter edge includes a handle extending outwardly therefrom, said second lateral perimeter edge is mounted to said two spaced apart hinges, said base member has a proximal perimeter edge and a distal perimeter edge, said two spaced apart hinges mounted to said proximal perimeter edge.

2. The device as claimed in claim 1 wherein said base member has a top end and a bottom end, one of said two spaced apart hinges is located adjacent to said top end and the other of said two spaced apart hinges is located adjacent to said bottom end.

3. The device as claimed in claim 1, wherein said base member and said foot arrestor member are selectively folded and un-folded.

4. The device as claimed in claim 1, wherein said support member and said base member are adapted to support a user's foot.

* * * * *